US005485068A

United States Patent [19]

Vaught

[11] Patent Number: 5,485,068

[45] Date of Patent: Jan. 16, 1996

[54] MULTIPLE PLUG-IN PROGRAMMABLE SENSORY DEVICE SYSTEM

[76] Inventor: Michael Vaught, Oscaleta Rd., South Salem, N.Y. 10590

[21] Appl. No.: 209,309

[22] Filed: Mar. 14, 1994

Related U.S. Application Data

[63] Continuation-in-part of Ser. No. 31,266, Mar. 15, 1993, Pat. No. 5,345,153.

[51] Int. Cl.[6] ..... H05B 39/04; F16M 11/00; A47G 35/00

[52] U.S. Cl. ..... 318/568.1; 248/915; 362/125; 362/806; 446/242; 446/297

[58] Field of Search ..... 318/567, 568.1; 248/915; 315/209 R, 210, 211; 362/124, 125, 257, 806, 808; 428/542.2; 446/242, 243, 297

[56] References Cited

U.S. PATENT DOCUMENTS

D. 252,688 8/1979 Ahn .
D. 258,450 3/1981 Ahn .
D. 259,120 5/1981 Ahn .
D. 265,836 8/1982 Ahn .
D. 269,970 8/1983 Cohen .
D. 277,474 2/1985 Miura .
D. 282,263 1/1986 Ahn .
D. 314,055 1/1991 Ross, Jr. .
D. 318,681 7/1991 Savage .
D. 323,525 1/1992 Wong .
D. 326,676 6/1992 Wolff .
3,463,918 8/1969 Franc .
3,691,675 9/1972 Rodgers .
3,720,128 3/1973 Frank .
3,747,459 7/1973 Schmidt .
3,768,175 10/1973 Hill et al. .
3,783,730 1/1974 Waters, Jr. .
4,253,045 2/1981 Weber .
4,358,792 11/1982 Domoleczny et al. .
4,400,736 8/1983 Weiss .
4,453,340 6/1984 Kozuka et al. .
4,459,893 7/1984 Kitamura .
4,544,218 10/1985 Sanders et al. .
4,637,007 1/1987 Sakurai .
4,652,998 3/1987 Koza et al. .
4,682,079 7/1987 Sanders et al. .
4,684,349 8/1987 Ferguson et al. .
4,890,008 12/1989 Chu .
4,937,107 6/1990 Mirish, Sr. .
4,947,722 8/1990 Lewis .
4,980,608 12/1990 Morrison .
5,116,648 5/1992 Martin .
5,191,319 3/1993 Kiltz .
5,270,480 12/1993 Hikawa .

*Primary Examiner*—Bentsu Ro
*Attorney, Agent, or Firm*—Nolte, Nolte and Hunter

[57] ABSTRACT

A control housing for operating in sequence a variety of remote, plug-in decorative sensory devices such as a Christmas ornamental closure which opens to a scene and other electromechanical ornaments, includes a power supply, audio amplifier, speakers, interface for the devices and a socket for interchangeable program modules which may be changed without tools by a user of the system.

11 Claims, 8 Drawing Sheets

MULTIPLE PLUG-IN PROGRAMMABLE SENSORY DEVICE SYSTEM

This is a continuation-in-part of U.S. Ser. No. 08/031,266, filed Mar. 15, 1993, now U.S. Pat. No. 5,345,153.

BACKGROUND OF THE INVENTION

1. Field of the Invention

This invention relates to remote controlled sensory effect devices such as interconnected Christmas ornaments, more specifically to a controller of multiple plug-in, sensory effect, devices in which the controller is reprogrammable by the user, and the controller and each device produces a sensory effect.

2. Description of the Prior Art

Christmas is a time when a variety of sensory ornaments are set up in an electrical working relationship with one another in order to provide an enhanced sensory effect.

Miniature lights, for example, are connected in series along a common electrical line which is wrapped on a Christmas tree as a string of lights. Each of many of the lights includes a thermomechanically operated switch which causes the light to blink, so that the lights of the string twinkle at random.

U.S. Pat. No. 4,682,079, patented Jul. 21, 1987 by Sanders et al, describes an ornament for installation in series with the lights of an AC voltage operated string of lights such as the miniature Christmas lights.

An input circuit in the ornament is connected in series with the lights. The circuit supplies DC voltage for operating loads in the ornament such as a motor, electronic music module, and lights, and provides voltage and current protection for the operating load circuit against voltage surges from the string, protection against shock hazard from failure of a component in the input circuit or load circuit, and to assure that sufficient current continues through the input circuit to allow the series string lights to function at full brilliance.

The loads include an electric motor with gear reduction and a turntable mounted within a hemispherical lower housing member which carries a miniature train. The motor rotates the turntable so that the miniature train moves into and out of a tunnel provided within an upper hemispherical member, illuminated from within by a lamp; a capacitance touch sensor circuit may be also provided in the ornament for switching on the load by touch, and a timer circuit is provided to turn the load off; instead of a moving train load, a music module may be provided; or the motor may drive a cam operated small Santa Claus figure within the transparent upper hemispherical member, wherein the Santa Claus moves toward and away from a small translucent tree containing a light.

Connection of this versatile ornament may be made, it is described, to the string of lights by a plug which replaces one of the miniature lamps in the string, as in Sanders et al U.S. Pat. No. 4,544,218. Ornaments in this system operate independently of one another and of the system as a whole.

One popular Christmas display system presently available, called Santa's Marching Band, made by Mr. Christmas, Inc. 41 Madison Avenue, New York, N.Y. 10010, has a plurality of miniature mechanical ornaments, each of which has a small figure rotatably mounted between two different sounding bells. The figure carries a striker and turns right or left to strike the respective bell.

Each ornament is connected by a pair of wires, one of the pair being common to all the ornaments, to a controller box. The controller box has a microprocessor circuit which sends DC current of plus or minus polarity with respect to the common line, to each ornament, driving the motor in the ornament to turn right or left depending upon the polarity of current sent to that ornament.

The ornaments are thus operated in various sequences to play tunes. The number of different tunes and each tune which can be played is limited by the number of figures and the musical note of each bell available at two per figure.

A new Christmas display called The Music Box Collection, showing early success in the market, is made by NOMA International, Inc., and is described in U.S. Pat. No. 5,345,153. The Music Box Collection comprises a plurality of ornamental boxes operated by a controller. Each box has a top that automatically opens for an animated scene that rises up from the box into view, upon receiving power from the controller.

In a particular embodiment of the invention, the closure is opened by moving a cover which, in turn, moves a platform incorporating a scene and triggers a mechanism which animates the scene, for example, by revolving the platform and scene.

The controller for multiple closure operation provides music during the opening and opened period of time for each closure and may vary the melody randomly or provide music specific to the animated scene.

A preferred embodiment of the invention provides a closure in the form of a box having a bottom comprising a container portion and a top hinged to an upper edge of the container portion. A clip or hanger or handle is provided to secure the box to a Christmas tree, if desired.

Circuitry is provided which energizes an electric motor which operates a power train to lift the lid about its hinges and at the same time lift a scene bearing platform within the box up to the level of the upper edges of the container portion. In the particular embodiment of the invention disclosed, as the platform raises, a switch acts to energize a second motor which operates a power train to animate, by rotating the platform and the scene disposed upon it.

The box is conceived as a music box, and in this respect, as the motor which lifts the lid is energized, a selected melody is played, electronically as programmed in a controller, although a pin roll and tone reed may, of course, be provided within the box according to the usual music box construction. The electronic controller is preferred and in the contemplated commercial embodiment of the invention provides eighteen Christmas carols played one at a time as each of six ornamental boxes is opened and closed, in sequence, as programmed.

SUMMARY OF THE INVENTION

It is one object of the invention to provide a multiple sensory device system comprising a controller for operating a plurality of sensory devices.

It is another object to provide a multiple sensory device system comprising a controller which directly produces sensory effects.

It is another object of the invention that the controller may be programmed by the user to change the direct sensory performance of the controller, and to change the sensory performance of the devices in the system.

It is another object that connection between the controller be adapted for connecting a plurality of sensory devices to the controller for operating the sensory devices.

It is yet another object that the controller provides music.

Another object is that the music emanates from the controller housing.

Another object is that the controller varies control of the sensory devices in accordance with the music.

It is another object that at least one of the sensory devices is an ornamental closure as disclosed in U.S. Pat. No. 5,345,153, much of which is described herein for the convenience of the reader.

The multiple programmable sensory device system includes a housing with remote circuit connection means mounted on the housing for temporary connecting of a plurality of electrically operated sensory effect devices to the system. The devices have predetermined electrical requirements for operating the devices for providing the sensory effects. The remote circuit connection means may be for temporary connection of one or more devices. The remote circuit connection means may be adapted for interchangeable connection of the devices.

A power supply that is mounted on the housing, is connected to the system for providing electrical power for operating the sensory effect devices and the system.

A microprocessor module is connected to the system for directing operation of the sensory effect devices in a sequence.

An audio amplifier is connected to the system for receiving preprogrammed sounds ordered by the microprocessor module, and a speaker, mounted on the housing is connected to the audio amplifier.

The microprocessor module includes durable connector means for temporarily connecting the microprocessor module to the system, and a cover over the module for gripping by a user for connecting and disconnecting the module from the system without tools. Durable connector means on the housing receives the connector means on the module and is electrically wired to the system for connecting the microprocessor module to the system.

A second microprocessor module on the housing that is connected to the system for operating the sensory effect devices is prevented from operating the sensor effect devices by means connected to the system for that purpose.

The remote circuit connection means includes a first and a second signal conducting means. The microprocessor module is programmed to direct play of a first discrete sound segment through the amplifier when it is directing via the first signal conducting means, operation of a sensory effect device, and to direct play of a second discrete sound segment through the amplifier when it is directing via the second signal conducting means, operation of a sensory effect device.

DETAILED DESCRIPTION OF THE INVENTION

Figure 1:
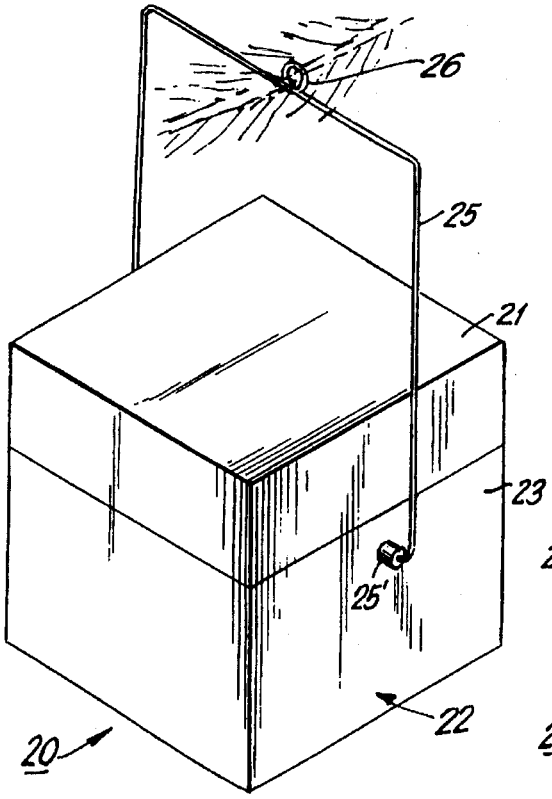
FIG. 1 is a perspective view of a box constructed in accordance with the invention and including a handle/hanger for securing it to a Christmas tree.

Referring to the drawings, a cube-shaped music box 20 is disclosed, having a top cover 21 covering a bottom container portion 22. The sides 23 of the box are provided with retainer holes 24 to receive the bearings 25' of wire handle 25 (shown only in FIG. 1) formed, in this instance, with a central loop 26 for engaging the branch of a Christmas tree.

Figure 2:
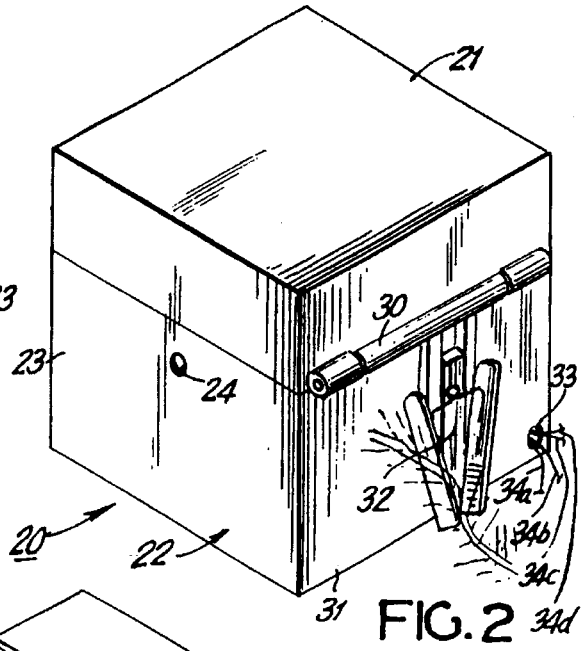
FIG. 2 is a perspective view of the box of FIG. 1 showing the rear side, the handle removed and including a clip for securing it to a Christmas tree.

The top 21 is hinged as at 30 to the bottom 23 along the upper edge of the rear wall 31 of the bottom which, as shown only in FIG. 2, is provided with a clip 32 as an alternate means to engage the branch of a Christmas tree. An aperture 33 in a lower corner of the rear wall provides a channel for electric wires 34*a*, 34*b*, 34*c* and 34*d*.

Figure 3:
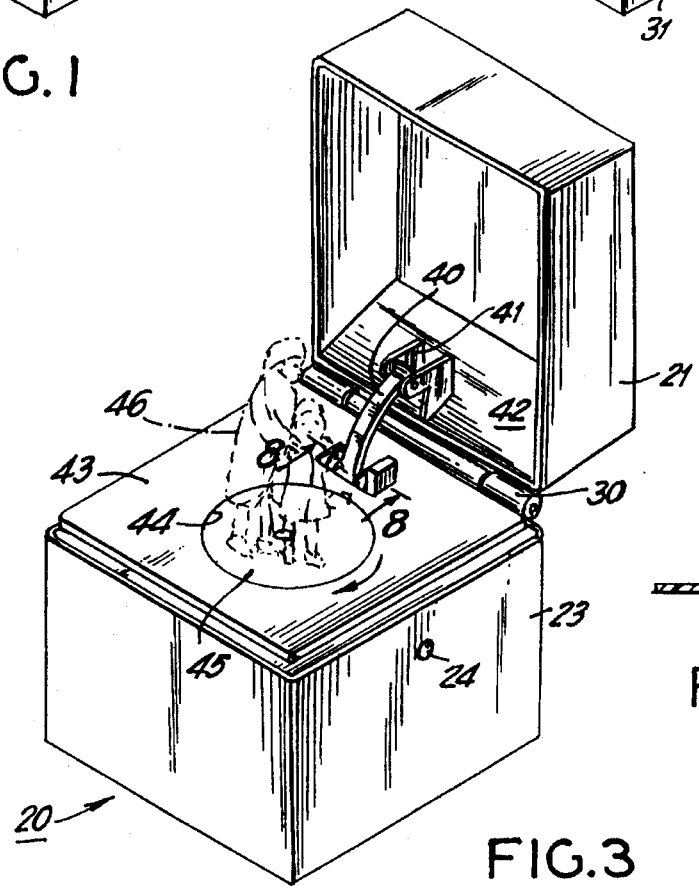
FIG. 3 is a perspective view of the box of FIGS. 1 and 2 shown with the lid opened.

As seen in FIG. 3, the top 21 is lifted about its hinges 30 via push bar 40 journaled at its upper end in bracket 41 secured to the rear wall 42 of top 21. A stage or floor lying along the plane of the upper edge of the bottom, where it is secured, underlies the top when the top is closed and is provided with a round cut-out area 44 filled with a platform 45 which rises from below the floor as the top is lifted. A scene 46 is disposed above the platform and revolves with the platform in the direction of the arrow when the platform is in place; i.e., coplanar with the floor.

In FIGS. 4–7, the front, rear and side walls have been removed from the bottom container portion 22 of the box as has the floor 43 and various parts of the operating mechanisms have been partially broken away in the several views so that the operations can be better appreciated.

The base 50 of the box supports motors 51 and 52, pulley bearings 53 and 54, posts 55, 56 and 57, gear shaft brackets 58 and 59 and push bar housing 60.

Posts 55–57 secure brackets (not shown) which stabilize the upper ends of shafts 68*s* and 100 as will be made clear.

When motor 51 is energized, its shaft 65 turns worm gear 66 and through sprocket 67, worm 68, sprocket 69 which turns shaft 70*s* and slip clutch 70*c* to turn sprocket 70 to lift rack 71, push bar 40 secured to rack 71 is lifted to pivot top 21 about its hinge 30 through bracket 41 in which the upper end of push bar 40 is journaled.

At the same time, yoke 80 which is secured to the bottom end of rack 71 via connection bar 81, along with switch bar 82 extending from yoke 80, are also lifted effecting the raising of platform 45 supported on shaft 90 for vertical sliding on the shaft with collar 91 on which it may rest or be formed integral with it, and which is raised by yoke 80.

Figure 8:
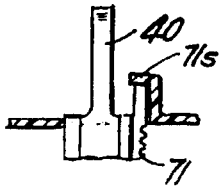
FIG. 8 is a sectional view taken along the line 8—8 of FIG. 3.
Figure 4:
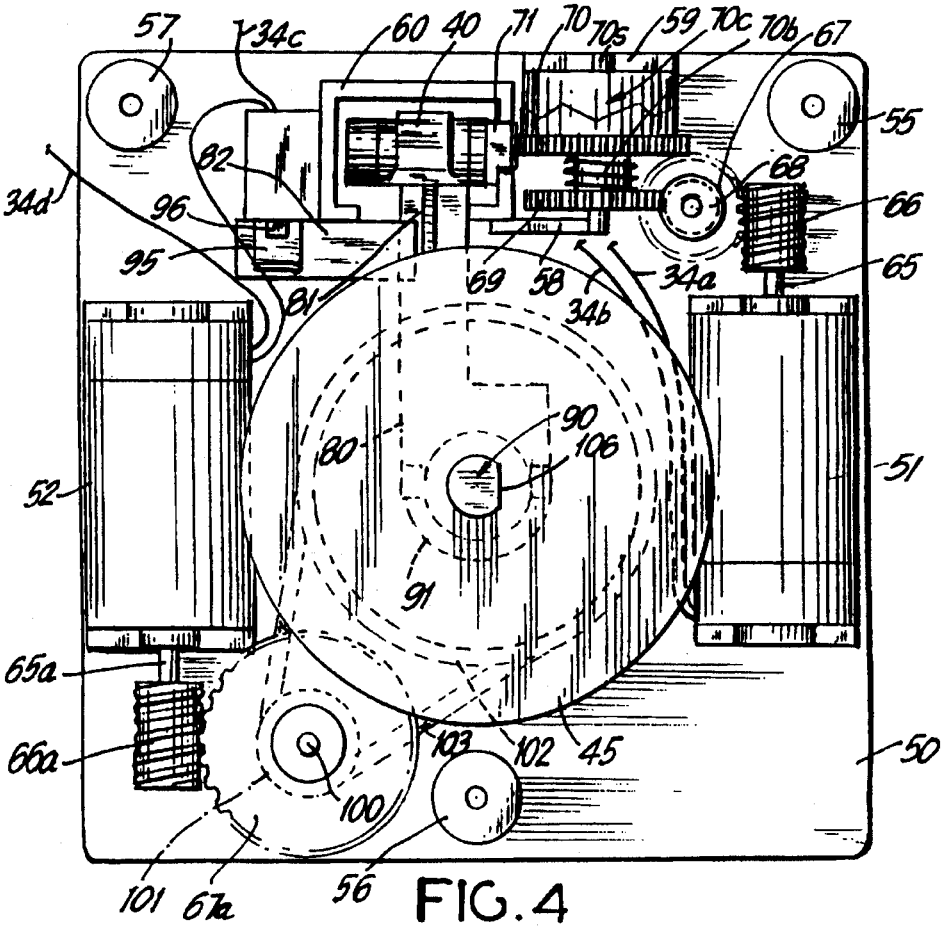
FIG. 4 is a top plan view of the inside of the box of FIGS. 1–3, the lid and side walls having been removed to show the operative elements, partially broken away.
Figure 5:
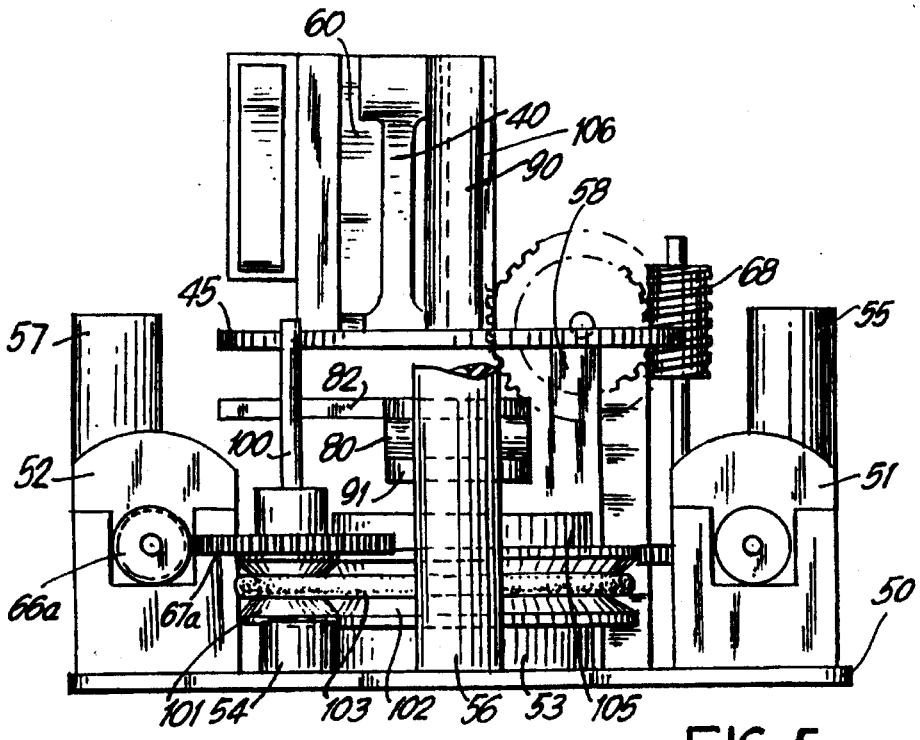
FIG. 5 is a frontal plan view of the inside of the box showing the operative elements, partially broken away.
Figure 6:
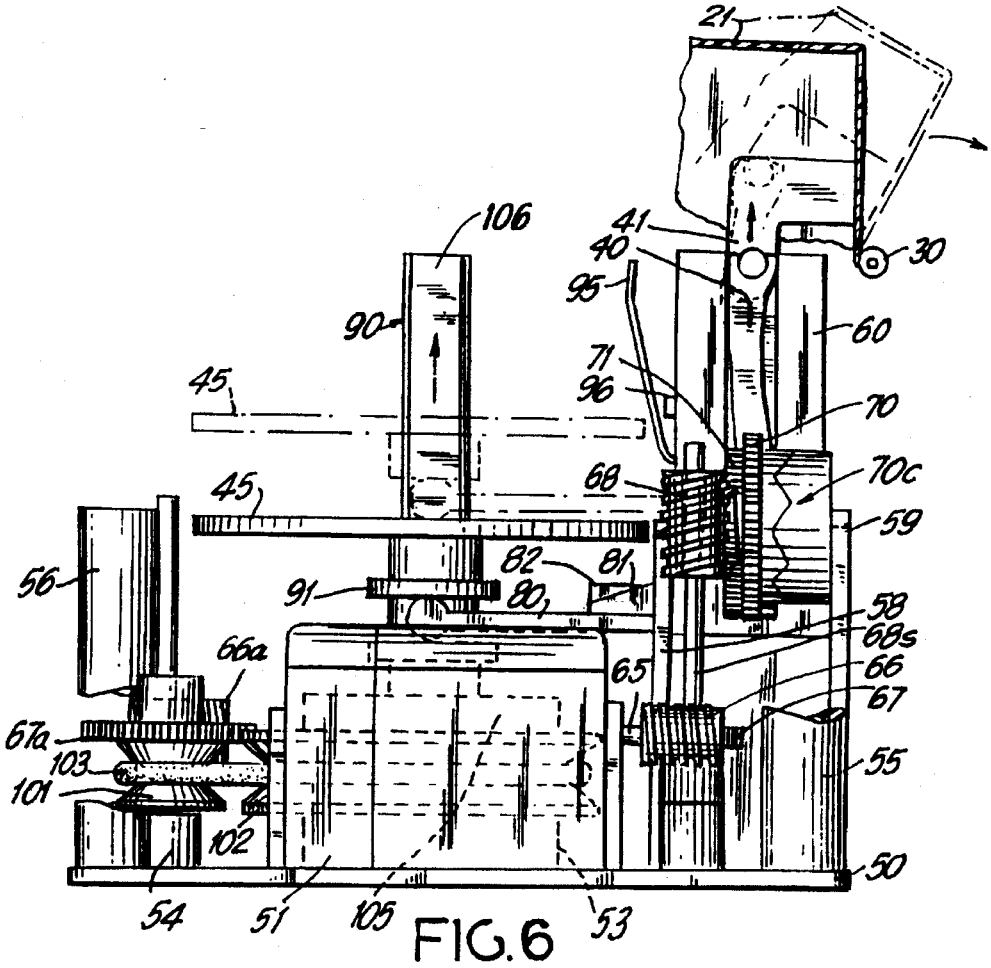
FIG. 6 is a view of the inside of the box taken from the right side to show the operative elements, partially broken away.
Figure 7:
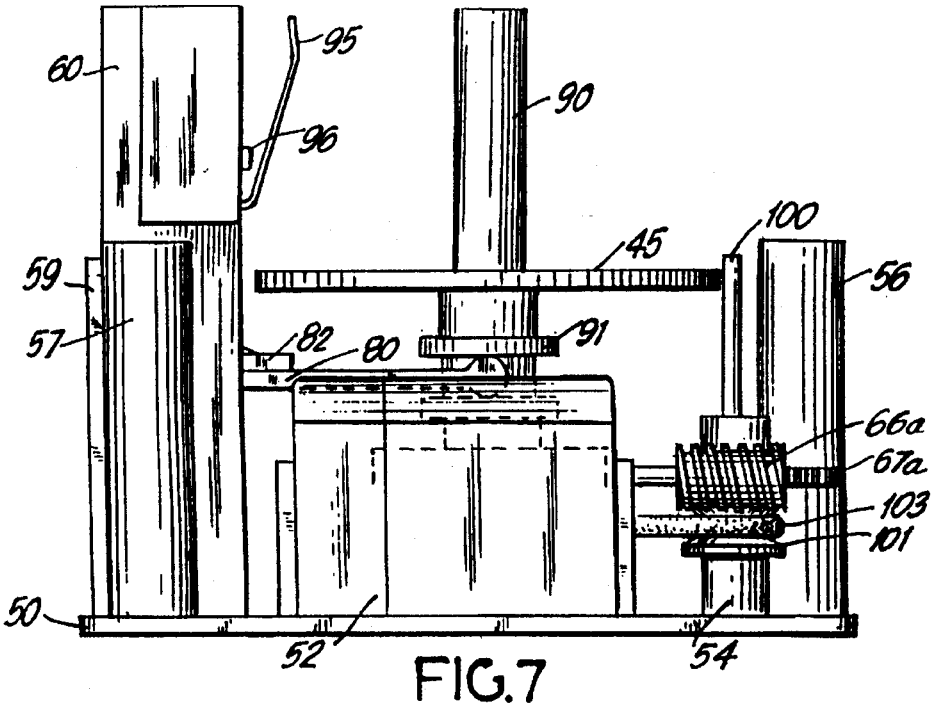
FIG. 7 is a view of the inside of the box taken from the left side.

As the yoke 80 is raised to its uppermost position; i.e., when the platform is coplanar with the floor 43, the switch bar 82 presses against switch spring 95 which depresses button 96 to close a switch which places motor 52 in circuit. Meanwhile, slip clutch 70*c* effects slipping of gear 70 against the bias of spring 70*b* as the upper end of the rack 71 abuts stop 71*s* (FIG. 8) on floor 43.

When motor 52 is energized, power shaft 65*a* turns worm gear 66*a* which in turn causes sprocket gear 67*a* to rotate shaft 100 to which drive pulley 101 is secured. Drive pulley 101 turns central pulley 102 via belt 103. Mounted on central pulley for rotation therewith is shaft mounting 105 to which platform shaft 90 is secured.

The shaft 90 is flattened as at 106, so that platform 45 and collar 91, having correspondingly shaped central apertures, will rotate with shaft 90.

Music is supplied from central controller 110 (FIG. 9) during the opening of the top and while the top is in the opened position. The programmed sequence cuts power to motor 52, reverses power polarity to motor 51 which drives the power train of gears in reverse to lower the platform and close the top.

Figure 9:
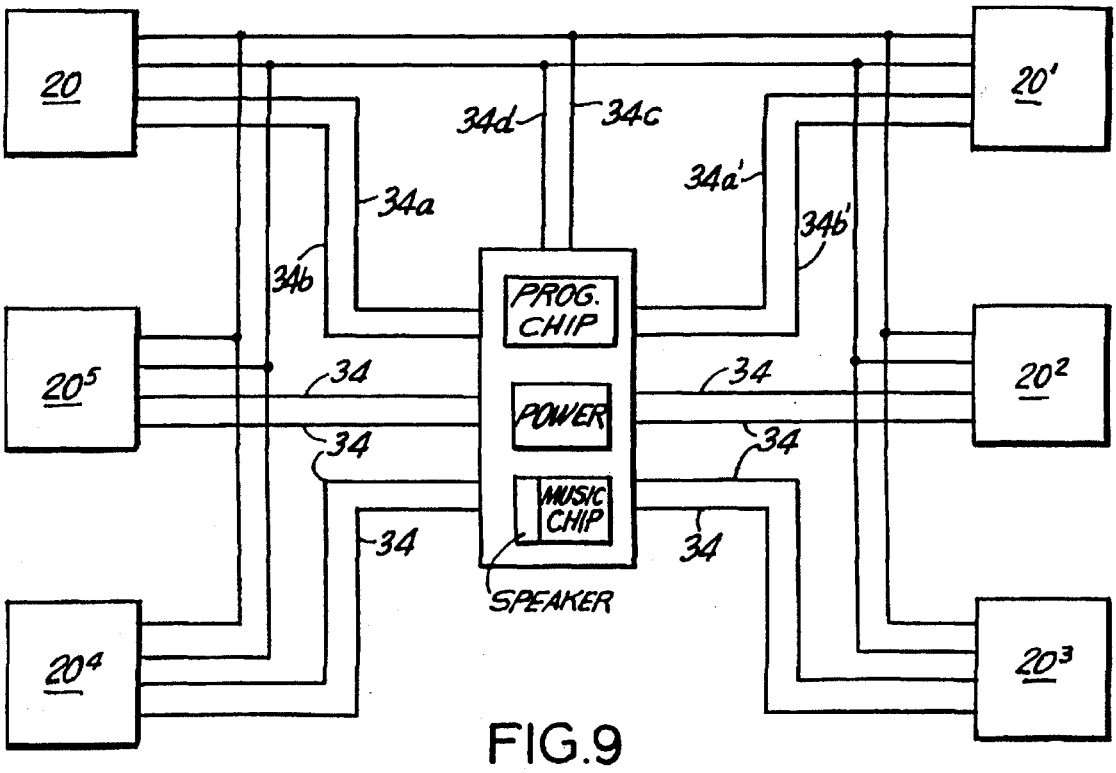
FIG. 9 is a schematic view of the controller and external circuitry to operate a plurality of boxes.

As seen in FIG. 9, the controller has been programmed to energize the motor 51 of box 20 through connectors 34*a* and 34*b* and the motor 52 through connectors 34*b* and 34*c*. When the sequence of operations is completed, the controller switches the power to wires 34*a*' and 34*b*' to energize the lifting motor in box $\mathbf{20}^1$. Inasmuch as the platform rotating motor in each box is switched off until the switch activated by button 96 is closed, connectors 34*d*, 34*c* are connected in series to each of the boxes 20, $\mathbf{20}^1$, $\mathbf{20}^2$, $\mathbf{20}^3$, $\mathbf{20}^4$ and $\mathbf{20}^5$.

As will be appreciated, the circuit can be designed in various other models to accomplish the desired lift/rotate objectives of the invention.

Figure 10:
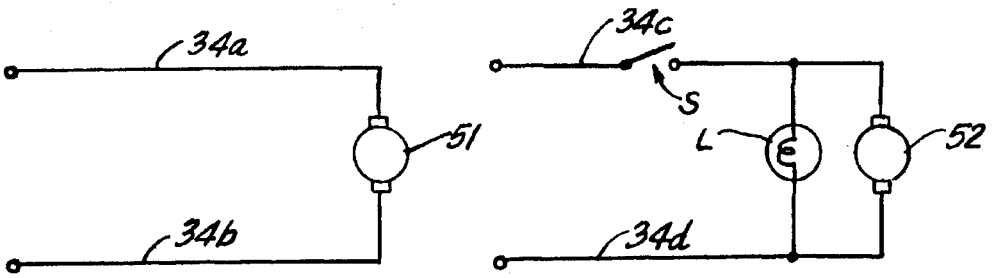
FIG. 10 is a diagram, a one circuit for energizing the box for operation.

In this last respect, FIG. 10 illustrates the wiring as discussed above, including wires 34*a* and 34*b* energizing motor 51 to lift the platform and depress the button 96 to close switch S to deliver power to motor 52 through wires 34*c* and 34*d*. In FIG. 10, a lamp L is included in the circuit to illuminate the walls of the bottom of the box, which may be translucent and carry a scene, when the platform is rotated. As previously noted, the polarity of wires 34*a* and 34*b* are reversed to reverse the action of motor 51.

Figure 11:
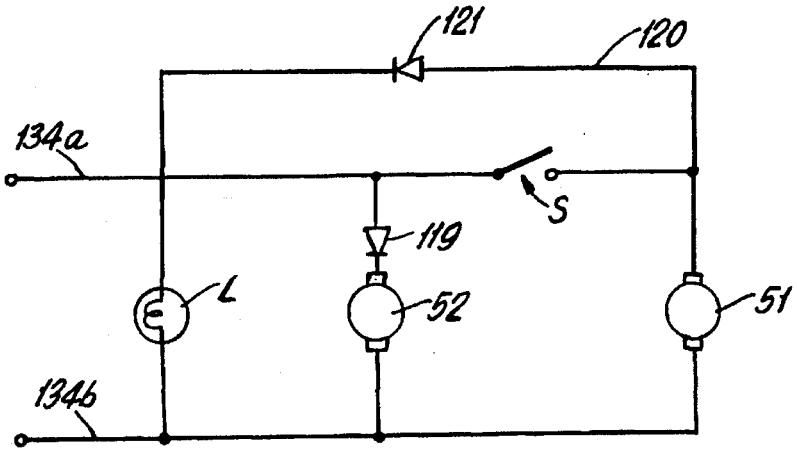
FIG. 11 is a diagram of another circuit for energizing the box for operation.

In FIG. 11, a single set of wires 134*a* and 134*b* energize the circuit to light the lamp and to energize the lift motor 51 when the switch S is closed. The lifting of the platform opens the switch, instead of closing it, to deenergize motor 51. Platform rotating motor is always energized through zener diode 119 in this circuit during the sequential operation of the box. The polarity of the wires is reversed and motor 51 is reversed in bypass circuit 120 through diode 121 and motor 52 is shut down.

Figure 12:
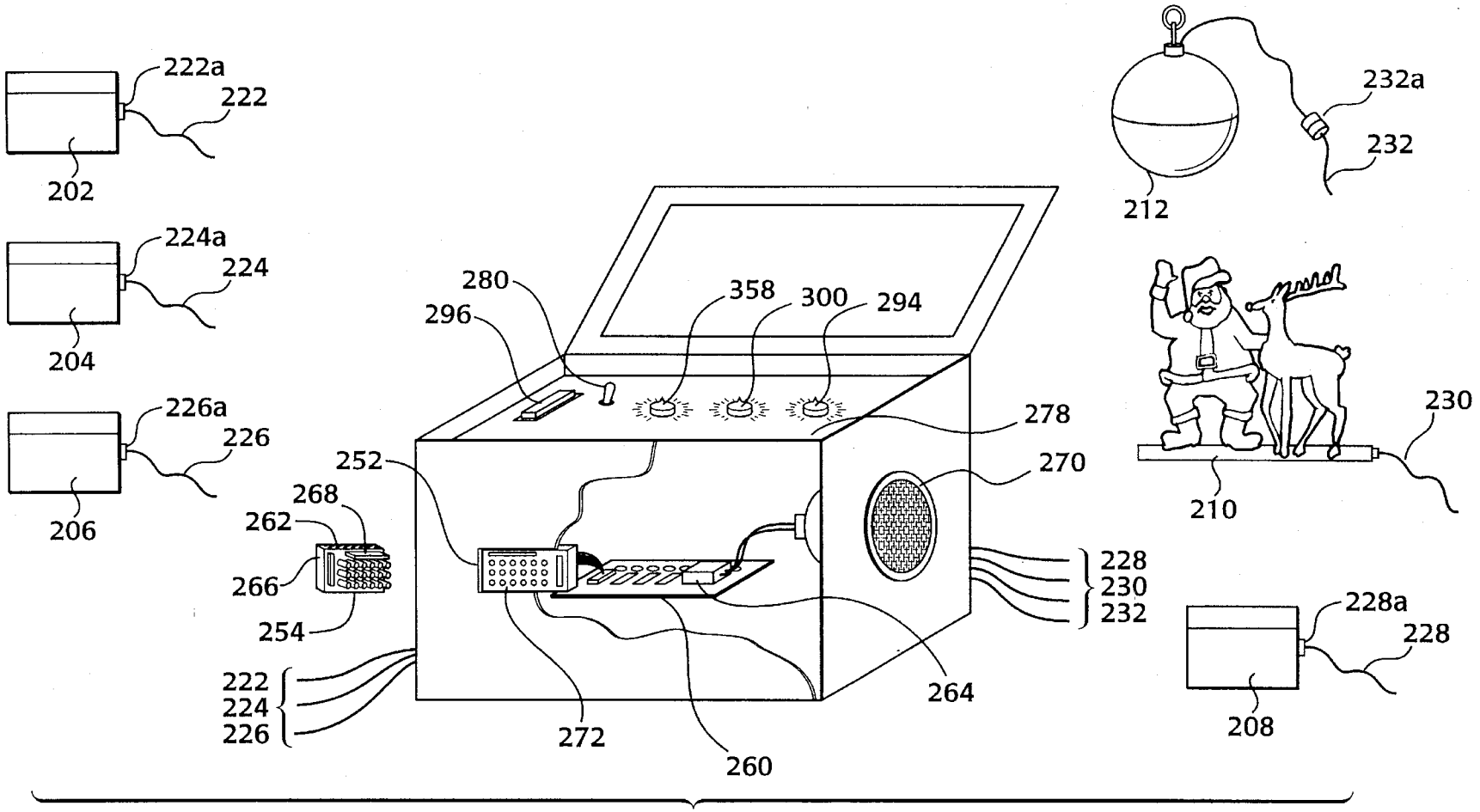
FIG. 12 is a schematic view of a preferred embodiment of the system of the present invention.

In the preferred embodiment shown in FIG. 12, controller 200 operates six sensory devices. Music boxes 202, 204, 206 and 208 operate as described above. Waving Santa 210 waves one arm and holds Rudolph the reindeer in the other. Rudolph's nose blinks in time to the waving arm. Cheery ball ornament 212 blinks and rotates.

Figure 13:
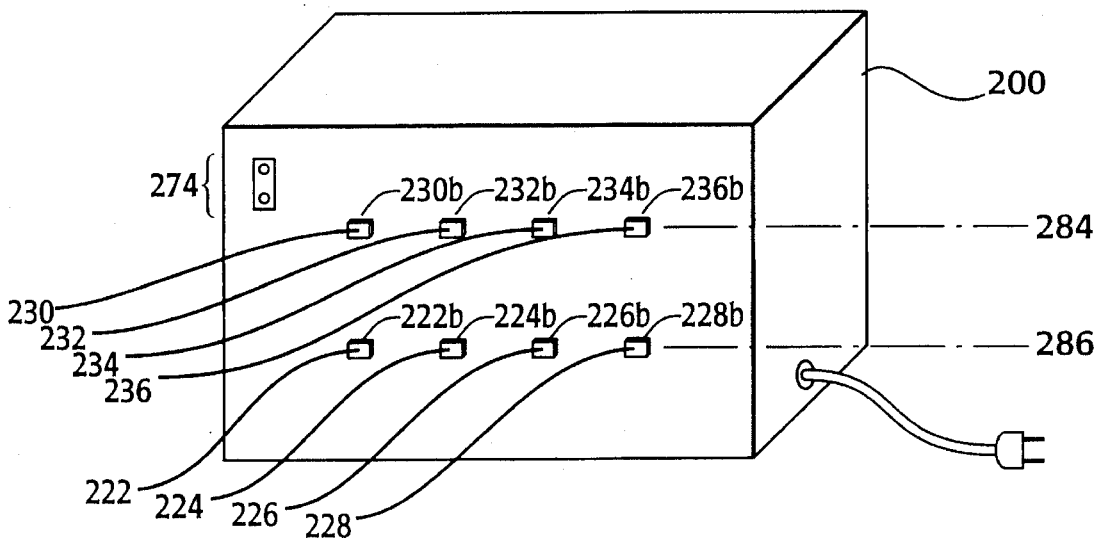
FIG. 13 is a rear view of the controller of the system shown in FIG. 12.
Figure 14:
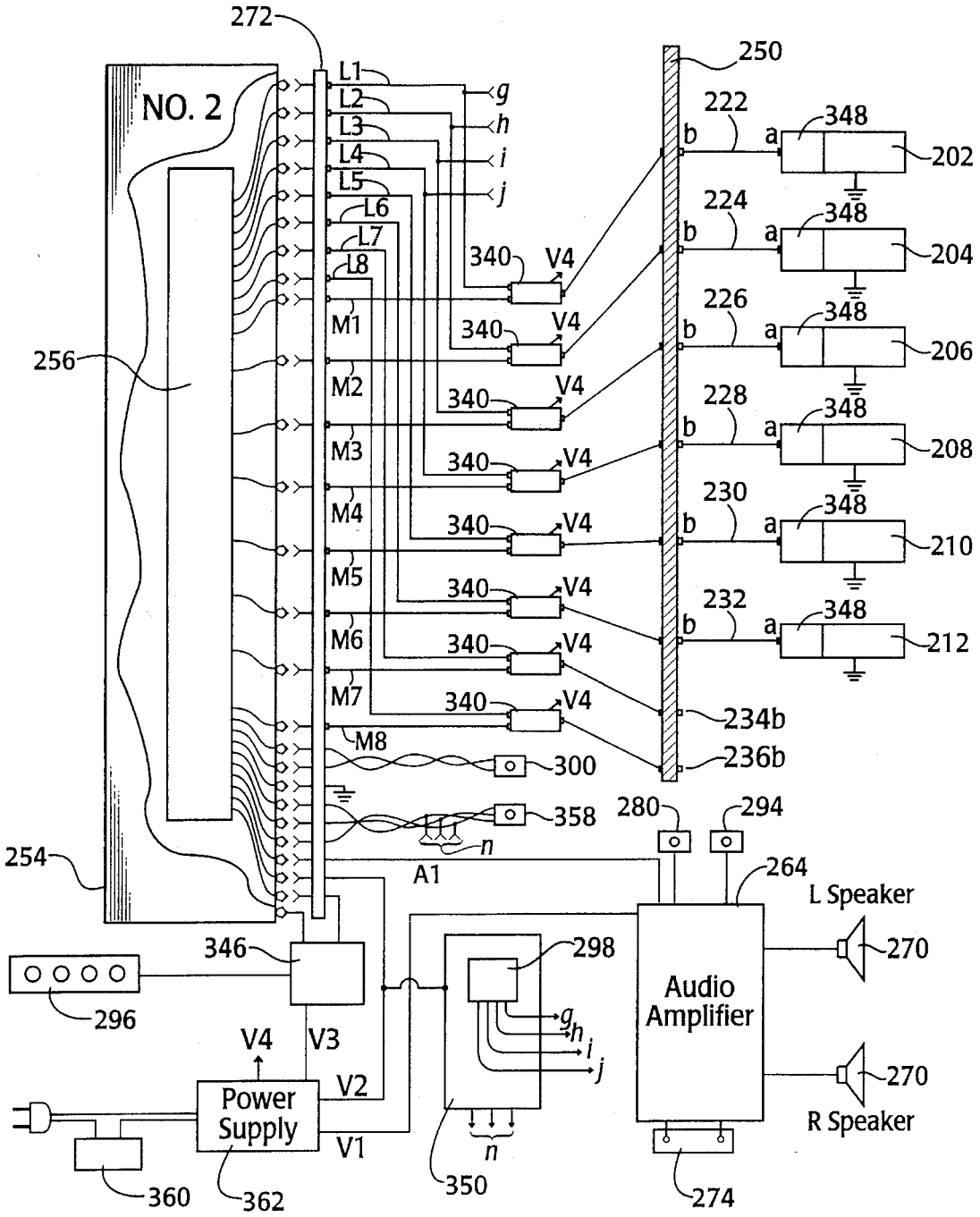
FIG. 14 is a schematic of a preferred embodiment of the invention.

Each device, as shown in FIGS. 12, 13 and 14, is connected to controller 200 by a respective line 222, 224, 226, 228, 230 and 232 and plug 222*a*, 222*b*, 224*a*, 224*b*, 226*a*, 226*b*, 228*a*, 228*b*, 230*a*, 230*b* and 232*a*, 232*b* at each end of the line. Plugs 234*b* and 236*b* are for additional devices, as the controller can operate eight devices.

Decorative control box 250 features program slot 252 for receiving a plug-in module 254 which provides a selection of melodies, sequences and instructions for operation of the devices. The sequence predetermines the order of operation of the sensory devices. The sequence may be a random order or a repeating order.

Plug-in program module 254, shown as No. 1 of a series of available preprogrammed program modules, connects via plug 258 to socket 272 which is wired to circuit board 260. Cover 266 insulates the contained circuitry from a user and provides textured hand grip surface 262 for removably connecting module 254 to the system without tools. Pin protector 268, shown in partial cut away, may be added to guide the plug on to socket 272, and protect the pins of plug 258. This is different from a simple plug-in IC chip which requires tools and is easily electrically damaged by handling through bending and static electricity, etc.

Circuit board 260 includes high quality stereo amplifier 264 for driving two speakers 270, one on each side of the box. Right speaker 270 shows in FIG. 12. Alternatively, the user may connect to audio jacks at the rear of the box for receiving the stereo audio signal for delivery to a home hi-fi stereo, large speaker system.

Circuit board 260 is also connected to user controls on upper panel 278 for setting functions of controller 200. Switch 280 controls whether the audio output is monaural or stereo. When switch 280 is set to stereo, and module 254 is number 1 of a series of plug-in program module choices, the speakers and the audio jacks deliver stereo music such as would be heard played by an orchestra.

Other program modules 254 such as module No. 2 of the series of modules, shown in FIG. 14, provides predetermined music and sound effects tailored to specific devices that are available for plugging onto the system. For example, jingle bells for an action sleigh scene music box, a bear growling (rather sweetly) for an animated bear scene music box and reindeer music with reindeer running hoof sound effects for Santa 210 display. Module 2 directs these tailored sounds to the left or right audio channel, so that the sound is thrown in the direction of the device as it may be set up.

In addition to providing music and sound effects related or tailored to specific devices, the plug-in module provides the operating sequence of the device to which the music or sound effect is related or tailored, so that the device activates at the appropriate moment the sound is played.

Plugs on row 284 (FIG. 13) operate devices which should be set to the left of box 250, and plugs on row 286 operate devices which should be set to the right of box 250.

User adjustment knob 294 provides for speaker volume control.

Panel 278 also provides user programmable options for a basic system when there is no module plugged in the system. For example, push button switch 296 selects one or more tunes which are built into the system on circuit board 260 in microprocessor 298 of internal program module 350. Switch 296 can, for example, select between music, music and bells, bells and other audio effects. Switch 300 selects between three options, lights, lights and music and music.

FIG. 14 shows a diagram of a preferred controller system according to the invention. A summary list and description of the circuits and switches of the diagram is herein presented:

Amplifier 264 provides stereo output to speakers 270 and audio jacks 274.

Power supply 362 provides power for:

stereo audio amplifier 264, power V1, internal program microprocessor module 350, power V2, external program microprocessors module 254, plug-in modules No. 1, No. 2, etc. of the series, power V2, internal/external program switching module 346, power V3, motor driver/light driver/coder module 340 (quantity 8), one module for each socket (b), four modules to row 284 left device sockets and four modules to row 286 right device sockets, V4.

Switching module 346 is activated by absence or presence of a plug-in module, for providing internal program microprocessor module outputs to the amplifier in the absence of a plug-in program module.

Decoder circuit 348, one on each sensory device selects two or three of; motor, light and motor direction sensory actions, according to design option. If a large number of choices are to be made available, the line between the coder and decoder may require more than one wire and a common ground.

Plug-in module No. 2 provides:

microprocessor 256, storage of songs/sound effects, timing of play of each, or response to end of song, stepper for sequencing to next song, stereo output to amplifier 264, reset to start at beginning of sequence on turn on of system, outputs (8) for motor activation to motor drive/light driver coders 340, outputs (8) for light activation, to motor driver/light driver coders 340.

Switches:

monaural/stereo 280, push button 296 selection of tunes and sound effects from program modules, lights/music/lights plus music 300, device count and sequence select 358, on/off 360 of main power to power supply 362.

As plug-in program module No. 2 of the series of plug-in program modules is inserted into program slot 252 it connects microprocessor 256 and associated circuitry in program module No. 2 to the system circuitry via socket 272, and actuates switch 346 which turns off internal program module 350 and connects switch 296 to microprocessor 256. Switch 296 is connected to internal program module 350 via switch 346 in the absence of a plug-in module.

Although for clarity and simplicity of description of the present invention, direct connections are shown between the microprocessor and socket 272, and between the parts of the system shown in the figures, it is to be understood that other circuit components may be included in the system according to good electronic and mechanical design practice known in the art, such as power transistors, relays and the like for making safe and reliable circuits.

Module No. 2 provides music and sound effects by way of line A1 to amplifier 264. It receives power V2 from power supply 362.

The operator selects one or more tunes and sound effects from a list provided with the plug-in module and keys them in on switch 296.

The operator also selects the desired combination of lights, music or music and lights on switch 300. The system can thus provide lighted effects with silence for the evening.

Switch 358 is set to the number of sensory devices plugged in to the controller, and so informs the appropriate microprocessor, so that the system steps to the devices and skips over the empty sockets such as **234*b* and 236*b*. Instead of indicating to the appropriate microprocessor via switch 358**, the number of sensory devices plugged in, a resistance sensor circuit (not shown) is used, attached to the sockets at the rear of the controller and to the microprocessor, to sense resistors in the plugs attached to the controller.

Microprocessor module 256 signals the appropriate motor driver, light driver/coder 340 in sequence, directing or ordering the desired activity selected by switch 300 and duration of the activity be driven in the device to which 340 is connected. Driver/coder 340 includes power transistors for driving the motor and/or light of the device, and a coding circuit which directs the device by way of decoder 348 to carry out the effect. Lines L1–L8 are for directing light sensory effects, and lines M1–M8 are for directing electromechanical sensory effects.

The coder/decoder information transfer can be by way of direct current voltage polarity, digital information, or other means known to the information transfer art. In lieu of the coder/decoder, the number of wires between each driver module and the relevant device can be increased so that each wire is dedicated to directly driving in the device, one of the activity choices.

Microprocessor module 256 also plays a discrete, and preferably different sound segment such as a particular tune, song or sound effect, for a limited segment of time, each time a different sensory device is operated.

Internal program module 350 microprocessor 298 interacts within the system similarly to microprocessor 256 when a program module is not plugged into the system. It serves a reduced number of channels, as is shown in FIG. 14, by connections g, h, i and j, which are disabled when a program module is plugged in.

Figure 15:
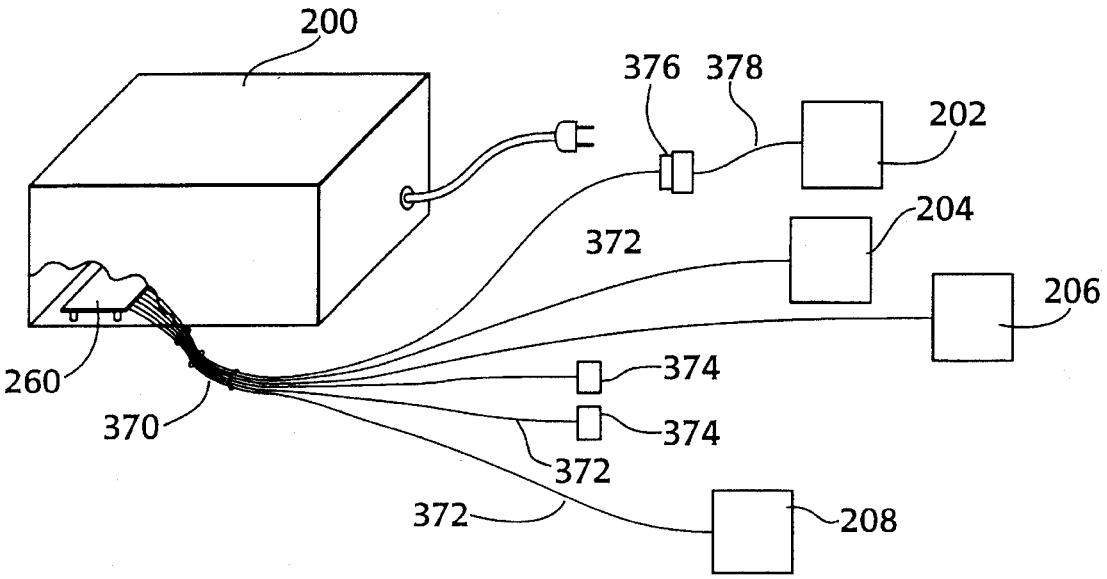
FIG. 15 is a schematic view of a controller connected with a plurality of sensory devices.

Referring now to FIG. 15, remote circuit connection means 370 which is mounted on controller 200 via circuit board 260, comprises a plurality of signal conductors 372 such as wire or optical fibers. Connection means 370 provides connection between the controller and music box sensory devices 202, 204, 206 and 208. Plugs 374 and 376 permit removable electrical attachment of boxes 204, 206 and various other sensory devices for operation by controller 200. Plug 376 connects box 202 by way of line 378.

Figure 16:
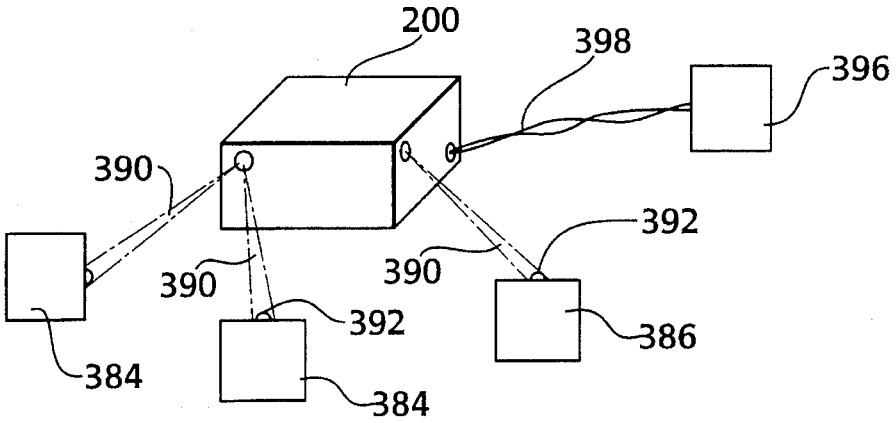
FIG. 16 is a schematic view of a controller connected with a plurality of sensory devices.

In FIG. 16, controller 200 operates sensory devices 382, 384 and 386 by way of infrared remote circuit connection means 390, and sensory device 396 by way of wire remote circuit connection means 398.

Having described an embodiment of the invention, it should be understood that the invention is not to be restricted to the disclosure herein, but rather to the scope of the following claims.

What is claimed is:

1. A multiple programmable sensory device system comprising:

a housing, a circuit, plug means mounted on said housing for temporarily connecting to said circuit a plurality of electrically operated sensory effect devices having predetermined electrical requirements for operating said sensory effect devices for providing sensory effects, power supply means mounted on said housing and connected to said circuit, for providing electrical power for operating said sensory effect devices and said circuit, a microprocessor module connected to said circuit for directing operation of said sensory effect devices in a sequence, and an audio amplifier connected to said circuit for receiving preprogrammed sounds ordered by said microprocessor module, said microprocessor module being a first microprocessor module and comprising durable connector means adapted for temporarily connecting said microprocessor module to said circuit, and a cover over said first module for gripping by a user for connecting and disconnecting said module from said circuit without tools, durable connector means on said housing for receiving said durable connector means on said first module, said durable connector means on said housing being electrically wired to said circuit for connecting of said first microprocessor module to said circuit.

2. The multiple programmable sensory device system described in claim 1, further comprising:

a second microprocessor module on said housing, connected to said plug means for operating said sensory effect devices, and means, connected to said circuit, for preventing said second microprocessor module from operating said sensory effect devices when said first microprocessor module is connected to said circuit.

3. The multiple programmable sensory device system described in claim 1, further comprising:

at least one of said sensory effect devices comprising electromechanical means for providing said sensory effects, being attached to said plug means.

4. The multiple programmable sensory device system described in claim 3, further comprising:

at least one of said sensory effect devices being a box comprising an electromechanical operating lid being attached to said plug means, and at least one of said sensory effect devices being an electromechanically operated ball being attached to said plug means.

5. The multiple programmable sensory device system described in claim 3, further comprising:

at least one of said sensory effect devices comprising light means for providing said sensory effects being attached to said plug means.

6. The multiple programmable sensory device system described in claim 1, further comprising:

a speaker on said housing, connected to said audio amplifier.

7. The multiple programmable sensory device system described in claim 6, further comprising:

a second microprocessor module having a different program than said first microprocessor module, for directing operation of said sensory devices and of preprogrammed sounds, being adapted for replacing said first microprocessor module by removable connection to said circuit by a user without tools.

8. A multiple programmable sensory device system comprising:

a housing, a circuit, plug means mounted on said housing for temporarily connecting to said circuit a plurality of electrically operated sensory effect devices having predetermined electrical requirements for operating said sensory effect devices for providing sensory effects, power supply means mounted on said housing and connected to said circuit, for providing electrical power for operating said sensory effect devices and said circuit, a microprocessor module connected to said Circuit, for directing operation of said sensory effect devices in a sequence, and an audio amplifier connected to said circuit for receiving preprogrammed sounds ordered by said microprocessor module, said plug means comprising a first plug and a second plug, said microprocessor module being programmed for directing play of a first discrete sound segment through said amplifier when directing via said first plug, operation of a sensory effect device, and said microprocessor module being programmed for directing play of a second discrete sound segment through said amplifier when directing via said second plug, operation of a sensory effect device.

9. A multiple programmable sensory device system comprising:

a housing, a circuit, plug means mounted on said housing for temporarily connecting to said circuit a plurality of electrically operated sensory effect devices having predetermined electrical requirements for operating said sensory effect devices for providing sensory effects, power supply means mounted on said housing and connected to said circuit, for providing electrical power for operating said sensory effect devices and said circuit, a microprocessor module connected to said circuit, for directing operation of said sensory effect devices in a sequence, and an audio amplifier connected to said circuit for receiving preprogrammed sounds ordered by said microprocessor module, said plug means comprising a first plug and a second plug, said audio amplifier being a stereo amplifier comprising a first audio channel and a second audio channel, a first speaker on said housing, a second speaker on said housing, said first and second speakers being connected to said first and second channels of said amplifier and oriented on said housing for left and right stereo separation, said microprocessor module being programmed for directing play of sound through said first channel when directing via said first plug, operation of a sensory effect device, and said microprocessor module being programmed for directing play of sound through said second channel when directing via said second plug, operation of a sensory effect device.

10. In a multiple programmable sensory device system, the combination comprising:

a controller housing, a circuit, plug means mounted on said controller housing for temporarily connecting to said circuit a plurality of electrically operated sensory effect devices having predetermined electrical requirements for operating said devices for providing sensory effects, power supply means mounted on said controller housing and connected to said circuit, for providing electrical power for operating said sensory effect devices and said circuit, a microprocessor module in said housing connected to said circuit, for directing operation of said sensory effect devices in a sequence, an audio amplifier connected to said circuit for receiving preprogrammed sounds ordered by said microprocessor module, and at least one electrically operated sensory effect device having predetermined electrical requirements for operating said device for producing sensory effects, said sensory effect device comprising:

an ornamental closure comprising a container portion, a cover, means mounting said cover for movement from a closed position covering at least a portion of said container portion to an open position exposing said portion of said container portion, a scene stored in a first position within said container portion, means mounting said scene for movement from said first position to a second position, exposed for viewing when said cover is in said open position, means for moving said cover to said open position to open said closure and expose said scene to view and means for moving said scene from said stored first position to said exposed second position;

said controller housing being spaced from said container portion, said microprocessor module in said housing comprising electronic programming means for directing operation of operating said means for moving said cover, and a flexible signal conducting line between said ornamental closure and said controller housing, connected to said electronic programming means and to said means for moving said cover for operating said means for moving said cover.

11. In the multiple programmable sensory device system of claim 10, the combination further comprising:

said ornamental closure being one of a plurality of like closures in said system, said system including electrical connecting means between said controller housing and said plurality of closures, said controller housing including means for sequentially operating each ornamental closure.

* * * * *